US006672363B2

(12) United States Patent
Schmidt

(10) Patent No.: US 6,672,363 B2
(45) Date of Patent: Jan. 6, 2004

(54) WINDOW SHADE WITH A SHADE PANEL

(76) Inventor: Manfred Schmidt, Dachenhauserweg 37, 71101 Schonaich (DE)

( * ) Notice: Subject to any disclaimer, the term of this patent is extended or adjusted under 35 U.S.C. 154(b) by 0 days.

(21) Appl. No.: 10/199,443

(22) Filed: Jul. 19, 2002

(65) Prior Publication Data

US 2003/0051828 A1 Mar. 20, 2003

(30) Foreign Application Priority Data

Aug. 16, 2001 (EP) ..... 01118877

(51) Int. Cl.[7] ..... A47G 5/02
(52) U.S. Cl. ..... 160/310; 74/437; 242/411
(58) Field of Search ..... 160/238, 310, 160/311, 315, 352; 74/437; 242/411, 407

(56) References Cited

U.S. PATENT DOCUMENTS 2,874,611 A * 2/1959 Luboshez ..... 359/596
3,195,616 A 7/1965 Taber
5,251,507 A * 10/1993 Takahara et al. ..... 74/567
5,671,387 A 9/1997 Jacobs et al.
6,021,683 A * 2/2000 Doege et al. ..... 74/44
6,354,354 B1 * 3/2002 Schmidt ..... 160/98
2003/0083165 A1 * 5/2003 Hessberger ..... 474/141

FOREIGN PATENT DOCUMENTS

DE 3045883 A1 7/1982
EP 0 737 795 A2 10/1996
EP 0 950 801 A1 10/1999
JP 3-145954 * 3/1991

* cited by examiner

*Primary Examiner*—Blair M. Johnson
(74) *Attorney, Agent, or Firm*—Woodling, Krost and Rust

(57) ABSTRACT

The invention pertains to a window shade with a shade panel, with a rotatable winding shaft 1 for winding up the panel onto the winding shaft 1 to form a roll 2 and for unwinding the panel from this winding shaft 1 to form a panel surface 3, and with a drive M. The invention is characterized in that control means R are provided upline of the winding shaft 1 to vary the rotational speed of the winding shaft in such a way that the winding shaft 1 has several periods in each revolution, where the angular velocity changes in a predetermined manner within each period.

43 Claims, 2 Drawing Sheets

WINDOW SHADE WITH A SHADE PANEL

The invention pertains to a window shade with a shade panel of the type indicated in the introductory clause of claim 1.

Many different designs of window shades with roll-up coverings for windows in buildings or for other openings are known, such as those designed as rolling shutters and rolling gates. In the basic vertical type of installation, the shade consists of a winding shaft at the top for winding up a shade panel onto the winding shaft and for unwinding it from the shaft to form a shade panel, the free-hanging end being weighted at the bottom by a rod.

In one particular design, the hanging shade consists of a thin, sheet-like panel, which has creases parallel to the winding shaft. EP 950 801 describes a window shade of this type. These creases give the surface of the panel a corrugated profile in the unwound state and give the wound-up panel roll a triangular profile.

This corrugated profile is perhaps advantageous as decoration for the surface of the panel, but it is also problematic, because it allows the shade to spring back and forth elastically in the longitudinal direction under tensile stress. As a result, the free-hanging shade panel weighted by the bottom rod can vibrate considerably during winding and unwinding. These vibrations impair the appearance of the shade and can also lead to malfunctions.

The invention is based on the task of improving a window shade of the type indicated in the introductory clause of claim 1 in such a way that the disadvantages cited above are avoided while at the same time the shade can be wound up and down smoothly.

This task is accomplished by the characterizing features of claim 1 in conjunction with the features of the introductory clause.

Additional solutions and embodiments of the invention form the objects of the subclaims.

The vibrations which occur during the winding and unwinding of shade panels, especially those with creases and the resulting corrugated profile, can be explained by the interaction of the following properties of the type of window shade considered here. The elastic surface of the shade panel works together with the bottom rod to create a spring-mass system, the resonance frequency of which varies with the length of the free-hanging part. If the shade roll has a certain profile such as a triangular profile, the tensile forces being transmitted to the panel increase and decrease periodically as the roll turns. These forces excite vibrations when they match the resonance frequency.

To solve this dynamic problem, therefore, control means are according to the invention installed upline of the winding shaft to vary the rotational speed of the winding shaft in such a way that the winding shaft has several periods in each revolution, the angular velocity changing in a predetermined manner in each period. This has the result of compensating for the out-of-round shape which may develop or which already exists on the winding shaft. In the case of a shade panel roll with an out-of-round profile, therefore, the tensile forces do not increase and decrease during the winding and unwinding operations. The shade panel moves up and down smoothly, without any vibrations.

The shade panel with creases can consist of plastic, metal, or some other elastic material.

A shade panel of plastic consists, for example, of polyester with a thickness of 0.01–0.15 mm. In one type of embodiment, the creases are parallel to the winding shaft, and the spacing between them is in the range of 7–40 mm, depending on the thickness of the panel, and the bending angle at the creases is 120–180 in the rotational direction of the panel roll.

A corresponding shade panel of metal consists, for example, of stainless spring steel with a thickness of 0.005–0.100 mm. The spacing of the creases is approximately 7–100 mm, depending on the thickness of the metal and on its modulus of elasticity.

The problem mentioned above occurs especially when the shade panel is provided with creases which allow the unwound surface of the shade panel to form a corrugated profile and the rolled-up panel to form a triangular profile on the winding shaft. The panel roll with a triangular profile has in this case approximately the shape of an equilateral triangle with rounded comers.

The effective roll radius which determines the linear movement of the shade panel varies accordingly between the maximum radius belonging to the comers and the minimum radius belonging to the sides. To compensate for this out-of-round profile, the control means vary the angular velocity in inverse proportion to the effective roll radius, so that the tangential velocity remains constant at the transition between the roll and the panel surface. The winding shaft thus has three periods, each with its own angular velocity curve. In correspondence with the geometry present here, the ratio between the minimum and maximum angular velocity is approximately 0.5–0.75.

The design of the control means can be basically either electronic or mechanical.

In the case of a purely mechanical design, the control means are installed between the winding shaft and the drive shaft. A reducing gear forms the control means in this case, in that it has at least one radial cam, which defines the periods with the changing angular velocity. In the case of a panel roll with a triangular profile, the cam is provided with three sections, so that the winding shaft acquires three periods, each with its own angular velocity curve.

The panel roll could also be rectangular or pentagonal, for example, in which case the reducing gear would be provided with cams capable of producing four or five periods.

The reducing gear can be designed in various ways. The following embodiments are explained below on the basis of a triangular panel roll.

In a first embodiment, the reducing gear is designed as a drive belt drive with drive belts passing around belt pulleys. The variation of the angular velocity is in this case achieved by giving the belt pulley connected to the winding shaft a triangular profile similar to that of the shade roll. The cam is thus on the belt pulley.

In a second embodiment, the control means can be designed as a synchronous belt drive with toothed belts passing over gearwheels, in which case the gearwheel connected to the winding shaft has a triangular profile. The cam is thus provided on the gearwheel. The second gearwheel, i.e., the one connected to the drive shaft, preferably also has a cam with a triangular, elliptical, or eccentric shape. It is obvious that the exact shape of these gearwheels with the cams will be designed in such a way that the toothed belt remains under uniform tension over the entire course of its revolution.

In addition, the reducing gear can be designed as a gearwheel transmission with eccentric, elliptical, or triangular gearwheels, in which case the gearwheel connected to the winding shaft is triangular. The cam is thus on the gearwheel. In the case of a combination of a triangular wheel with an elliptical wheel, the reduction ratio is 3:2, and in the case of a combination of a triangular wheel with an elliptical wheel, the ratio is 3:1.

In a special variant, several triangular gearwheels are arranged in a row. In this way, it is possible, if necessary, to span a large distance between the winding shaft and the drive shaft. The gearwheel connected to the drive shaft can also be elliptical or eccentric, so as to achieve, for example, a reduction of 3:2 or 3:1.

The transmission can also comprise one or more universal joints. In this case, advantage is taken of the principle that universal joints, the shafts of which are at an angle to each other, vary their angular velocity twice per revolution in accordance with a sine function. Because three periods per revolution are required to compensate for a triangular panel roll formed by a creased shade panel, a gear with a reduction ratio of 3:2 is installed between the universal joint and the winding shaft.

In the case of an electronic design, the drive shaft is connected directly to the winding shaft. Here the electronic speed control unit of the shade drive forms the control means which changes the angular velocity within each period.

When, for example, the shade panel has creases and the panel roll has a triangular form, the drive shaft will therefore change its angular velocity in each of three separate periods per revolution. Suitable electronic speed controllers, which can also include sensors for measuring rotational angles and rotational speeds, are already known to the expert.

In a variant of this embodiment, the basic rotational speed can be switched between two or more additional speed settings. The electronic speed control unit can be switched between at least two different velocity profiles per revolution. A signal transmitter is used to generate the switching signal for switching between one velocity profile and another when the shade panel has been unwound to a certain length. Changing the basic rotational speed in this way makes it possible to avoid resonance, the frequency of which varies with the length of the wound or unwound shade panel.

Additional advantages and features of the invention can be derived from the following description of several embodiments of the invention in conjunction with the drawing.

Figure 1:
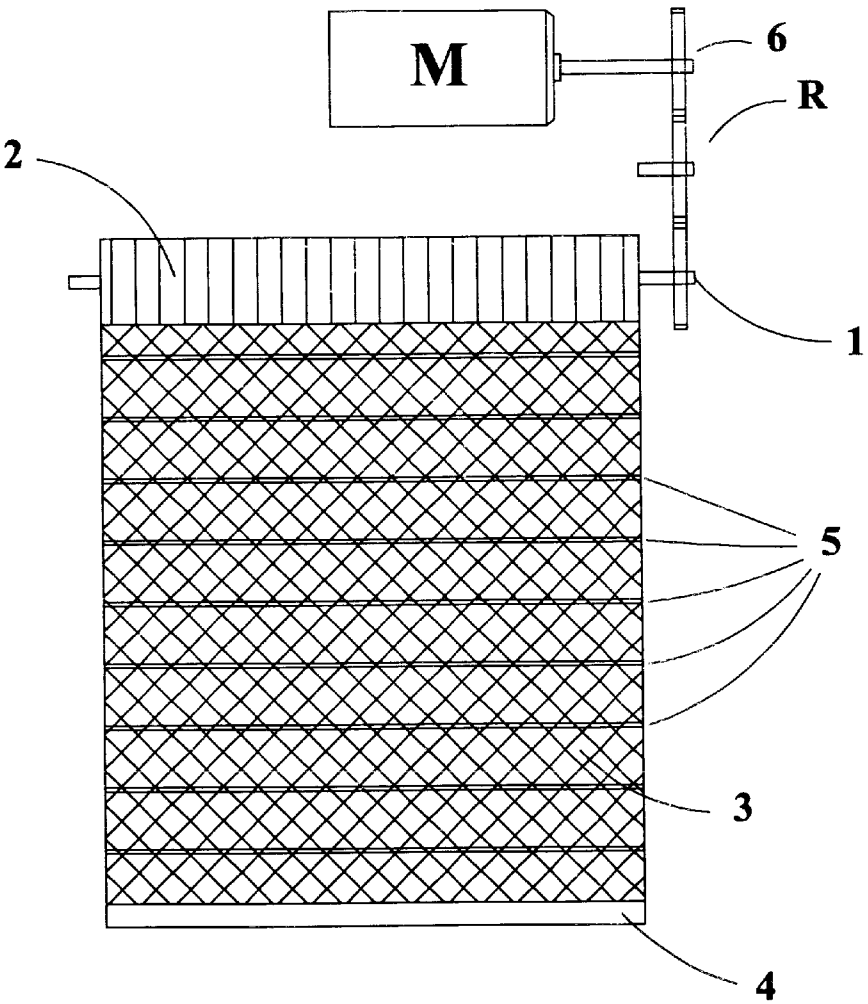
FIG. 1 shows a schematic diagram, from the front, of a window shade according to a first embodiment of the invention.

FIG. 1 shows a window shade with a winding shaft 1 for winding up a shade panel to form a panel roll 2 and for unwinding the panel to form a panel surface 3, at the free end of which a bottom rod 4 is provided.

Creases 5, which are parallel to the winding shaft 1, are introduced into the shade panel. A shade drive M is formed by an electric motor, the drive shaft 6 of which acts via a reducing gear R on the winding shaft 1. The reducing gear R is installed between the drive shaft 6 and the winding shaft 1 and, in the embodiment shown here, is designed as a gearwheel transmission. This gearwheel transmission is explained in greater detail below on the basis of FIG. 5.

Figure 2:
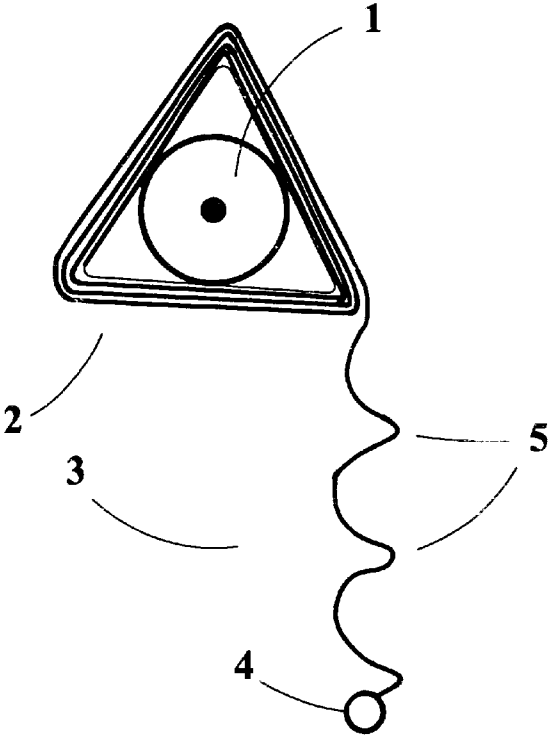
FIG. 2 shows a cross-sectional view, from the side, of the window shade of FIG. 1 with the panel roll and the shade panel.

FIG. 2 shows a cross section through the window shade of FIG. 1 from the side. As a result of the creases 5, the shade panel winds itself up into a panel roll 2 with a triangular profile, and the free-hanging panel surface 3 acquires a corrugated profile. As a result of this corrugated profile, the panel surface 3 springs elastically back and forth in the longitudinal direction, working together with the bottom rod 4 to create a spring-mass system which is capable of vibrating. As the panel roll 2 turns, periodically changing tensile forces emanate from the triangular profile and cause vibrations when resonance is achieved.

Figure 3:
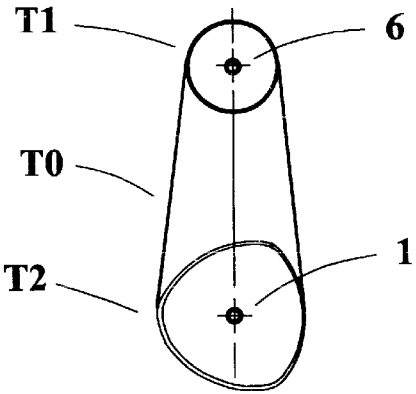
FIG. 3 shows a schematic diagram of a drive belt reducing gear according to another embodiment of the invention.

FIG. 3 shows the reducing gear as a drive belt transmission with a revolving drive belt T0. The drive pulley T1 is circular, whereas the belt pulley T2 connected to the winding shaft 1 has a cam surface in the form of a triangular profile, which is approximately the same as that of the panel roll. As a result, the angular velocity changes over the course of three separate periods per revolution.

Figure 4:
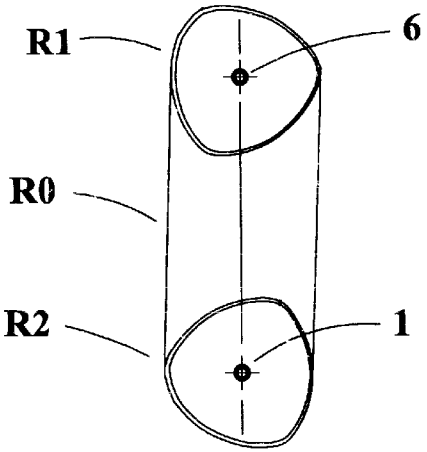
FIG. 4 shows a schematic diagram of a toothed belt reducing gear according to another embodiment of the invention.

FIG. 4 shows the reducing gear in the form of a synchronous transmission with a revolving toothed belt R0. In this exemplary embodiment, the two gearwheels R1 and R2 are designed with cam surfaces with a triangular profile, although only the gearwheel R2 connected to the winding shaft 1 must be triangular. The other wheel, i.e., the drive wheel R1, could also be eccentric or elliptical in shape so as to achieve, for example, a speed reduction ratio of 3:1 or 3:2.

Figure 5:
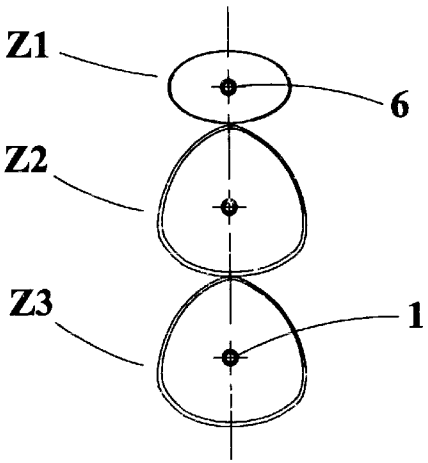
FIG. 5 shows a schematic diagram of a gearwheel transmission according to another embodiment of the invention.

FIG. 5 shows another reducing gear in the form of a gearwheel transmission with gearwheels Z1, Z2, and Z3 arranged in a row. The gearwheel Z1 connected to the drive shaft 6 is provided with a cam, which, in this exemplary embodiment, is elliptical in design, so that, in addition to the change in angular velocity, a speed-reduction ratio of 3:2 is achieved at the same time. The series of three gearwheels Z1, Z2, and Z3 shown here can, of course, be extended by additional gearwheels, each with its own triangular cam, so as to span a large distance between the drive shaft 6 and the winding shaft 1.

The methods used to calculate and to produce gearwheels with this type of cam are known in principle to the expert.

Figure 6:
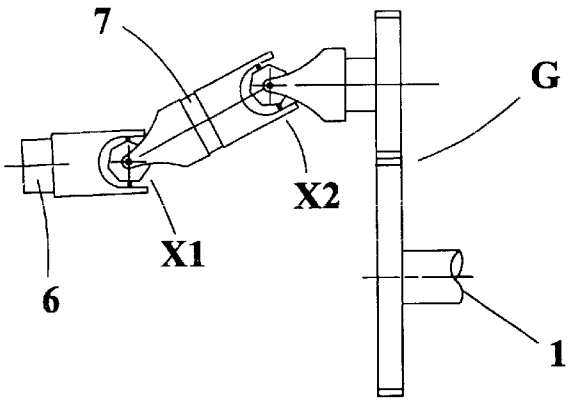
FIG. 6 shows a schematic diagram of a reducing gear with universal joints according to another embodiment of the invention.

FIG. 6 shows another embodiment of a reducing gear with universal joints X1 and X2 for producing a periodically changing angular velocity. As this exemplary embodiment shows, the shaft 7 is arranged at a certain angle to the drive shaft 6, as a result of which the angular velocity at the two universal joints X1 and X2 varies twice per revolution in accordance with a sine curve.

Because three periods of changing angular velocity per revolution are required to compensate for a creased panel roll with the resulting triangular profile, a gearwheel transmission G with a reduction ratio of 3:2 is installed downline.

List of Reference Numbers

1 winding shaft
2 panel roll
3 panel surface
4 bottom rod
5 crease
6 drive shaft
R0 toothed belt
R1, R2 gearwheel
T0 drive belt
T1, T2 belt pulley
Z1, Z2, Z3 gearwheel X1, X2 universal joint
G 3:2 reducing gear
R control means
M shade drive, electric motor

I claim:

1. Window shade with a shade panel, with a rotatable winding shaft (1) for winding up the shade panel onto this winding shaft (1) to form a panel roll (2) and for unwinding the shade panel from this winding shaft (1) to form a panel surface (3), and with a window shade drive (M), characterized in that control means (R) are provided upline of the winding shaft (1) to vary the rotational speed of the winding shaft in such a way that the winding shaft 1 has several periods in each revolution, where the angular velocity changes in a predetermined manner within each period.

2. Window shade according to claim 1, characterized in that the window shade panel is provided with creases (5), which give the panel surface (3) a corrugated profile and the panel roll wound up on the winding shaft (1) a triangular profile.

3. Window shade according to claim 2, characterized in that the shade panel consists of polyester with a thickness of 0.010–0.150 mm, and in that the distance between the creases (5) is 7–40 mm.

4. Window shade according to claim 2, characterized in that the shade panel consists of metal with a thickness of 0.005–0.100 m, and in that the distance between the creases (5) is 7–100 mm.

5. Window shade with a reducing gear installed between the winding shaft (1) and the window shade drive (M) according to claim 1, characterized in that the reducing gear forms the control means (R) by virtue of at least one cam, which defines the periods with changing angular velocity.

6. Window shade according to claim 2, characterized in that the control means (R) has three periods, each with its own change in the angular velocity of the winding shaft (1) during winding and unwinding.

7. Window shade according to claim 3, characterized in that the control means (R) has three periods, each with its own change in the angular velocity of the winding shaft (1) during winding and unwinding.

8. Window shade according to claim 4, characterized in that the control means (R) has three periods, each with its own change in the angular velocity of the winding shaft (1) during winding and unwinding.

9. Window shade according to claim 1, characterized in that the change in the angular velocity is the same in each of the periods.

10. Window shade according to claim 6, characterized in that the change in the angular velocity is the same in each of the periods.

11. Window shade according to claim 7, characterized in that the change in the angular velocity is the same in each of the periods.

12. Window shade according to claim 8, characterized in that the change in the angular velocity is the same in each of the periods.

13. Window shade according to claim 6, characterized in that the reducing gear (R) is designed as a drive belt reducing gear, and in that the cam is on a belt pulley (T2).

14. Window shade according to claim 7, characterized in that the reducing gear (R) is designed as a drive belt reducing gear, and in that the cam is on a belt pulley (T2).

15. Window shade according to claim 8, characterized in that the reducing gear (R) is designed as a drive belt reducing gear, and in that the cam is on a belt pulley (T2).

16. Window shade according to claim 6, characterized in that the reducing gear (R) is designed as a toothed belt transmission, and in that the cam is on at least one gearwheel (R1, R2).

17. Window shade according to claim 7, characterized in that the reducing gear (R) is designed as a toothed belt transmission, and in that the cam is on at least one gearwheel (R1, R2).

18. Window shade according to claim 8, characterized in that the reducing gear (R) is designed as a toothed belt transmission, and in that the cam is on at least one gearwheel (R1, R2).

19. Window shade according to claim 6, characterized in that the reducing gear (R) is designed as a toothed belt transmission, and in that the cam is on at least one gearwheel (Z1, Z2, Z3).

20. Window shade according to claim 7, characterized in that the reducing gear (R) is designed as a toothed belt transmission, and in that the cam is on at least one gearwheel (Z1, Z2, Z3).

21. Window shade according to claim 8, characterized in that the reducing gear (R) is designed as a toothed belt transmission, and in that the cam is on at least one gearwheel (Z1, Z2, Z3).

22. Window shade according to claim 19, characterized in that the gearwheel transmission comprises three or more gearwheels (Z1, Z2, Z3) with cams, where the first gearwheel (Z1), which is connected to the drive shaft (6), has a triangular, elliptical, or eccentric design, and in that the second (Z2) and the remaining gearwheels (Z3) all have essentially the same triangular design.

23. Window shade according to claim 20, characterized in that the gearwheel transmission comprises three or more gearwheels (Z1, Z2, Z3) with cams, where the first gearwheel (Z1), which is connected to the drive shaft (6), has a triangular, elliptical, or eccentric design, and in that the second (Z2) and the remaining gearwheels (Z3) all have essentially the same triangular design.

24. Window shade according to claim 21, characterized in that the gearwheel transmission comprises three or more gearwheels (Z1, Z2, Z3) with cams, where the first gearwheel (Z1), which is connected to the drive shaft (6), has a triangular, elliptical, or eccentric design, and in that the second (Z2) and the remaining gearwheels (Z3) all have essentially the same triangular design.

25. Window shade according to claim 13, characterized in that the reducing gear (R) comprises one or more universal joints (X1, X2) from which shafts (6, 7) extend at predetermined angles.

26. Window shade according to claim 14, characterized in that the reducing gear (R) comprises one or more universal joints (X1, X2) from which shafts (6, 7) extend at predetermined angles.

27. Window shade according to claim 15, characterized in that the reducing gear (R) comprises one or more universal joints (X1, X2) from which shafts (6, 7) extend at predetermined angles.

28. Window shade according to claim 16, characterized in that the reducing gear (R) comprises one or more universal joints (X1, X2) from which shafts (6, 7) extend at predetermined angles.

29. Window shade according to claim 17, characterized in that the reducing gear (R) comprises one or more universal joints (X1, X2) from which shafts (6, 7) extend at predetermined angles.

30. Window shade according to claim 18, characterized in that the reducing gear (R) comprises one or more universal joints (X1, X2) from which shafts (6, 7) extend at predetermined angles.

31. Window shade according to claim 19, characterized in that the reducing gear (R) comprises one or more universal joints (X1, X2) from which shafts (6, 7) extend at predetermined angles.

32. Window shade according to claim 20, characterized in that the reducing gear (R) comprises one or more universal joints (X1, X2) from which shafts (6, 7) extend at predetermined angles.

33. Window shade according to claim 21, characterized in that the reducing gear (R) comprises one or more universal joints (X1, X2) from which shafts (6, 7) extend at predetermined angles.

34. Window shade according to claim 1, characterized in that the control means (R) are formed by an electric motor (M) with electronic speed control.

35. Window shade according to claim 6, characterized in that the control means (R) are formed by an electric motor (M) with electronic speed control.

36. Window shade according to claim 7, characterized in that the control means (R) are formed by an electric motor (M) with electronic speed control.

37. Window shade according to claim 8, characterized in that the control means (R) are formed by an electric motor (M) with electronic speed control.

38. Window shade according to claim 5, characterized in that the control means (R) are formed by an electric motor (M) with electronic speed control.

39. Window shade according to claim 34, characterized in that the electronic speed control can be switched between at least two different velocity profiles per revolution and is provided with a signal transmitter for switching from one velocity profile to another, where the signal transmitter generates a switching signal when the panel surface has been unwound to a certain length.

40. Window shade according to claim 35, characterized in that the electronic speed control can be switched between at least two different velocity profiles per revolution and is provided with a signal transmitter for switching from one velocity profile to another, where the signal transmitter generates a switching signal when the panel surface has been unwound to a certain length.

41. Window shade according to claim 36, characterized in that the electronic speed control can be switched between at least two different velocity profiles per revolution and is provided with a signal transmitter for switching from one velocity profile to another, where the signal transmitter generates a switching signal when the panel surface has been unwound to a certain length.

42. Window shade according to claim 37, characterized in that the electronic speed control can be switched between at least two different velocity profiles per revolution and is provided with a signal transmitter for switching from one velocity profile to another, where the signal transmitter generates a switching signal when the panel surface has been unwound to a certain length.

43. Window shade according to claim 38, characterized in that the electronic speed control can be switched between at least two different velocity profiles per revolution and is provided with a signal transmitter for switching from one velocity profile to another, where the signal transmitter generates a switching signal when the panel surface has been unwound to a certain length.

* * * * *